United States Patent [19]

Eckelkamp

[11] 4,290,582

[45] Sep. 22, 1981

[54] WALL PULLER TOOL

[76] Inventor: Gene R. Eckelkamp, 316 Diener Rd., Washington, Mo. 63090

[21] Appl. No.: 29,673

[22] Filed: Apr. 11, 1979

[51] Int. Cl.[3] ..... B66F 3/00

[52] U.S. Cl. ..... 254/15

[58] Field of Search ..... 52/74 S; 254/21, 22, 254/15, 16, 120, 131; 145/1 R, 1 A, 1 B

[56] References Cited

U.S. PATENT DOCUMENTS 303,492 8/1884 Crow ..... 254/44

3,779,515 12/1973 Larlos ..... 254/131

*Primary Examiner*—John E. Murtagh

*Attorney, Agent, or Firm*—Glenn K. Robbins

[57] ABSTRACT

A wall puller tool and method for pulling or straightening walls. The wall puller tool is comprised of a steel pin-like shaft having a sharply pointed bottom end adapted to be struck into a plywood floor or the like and a pivotable laterally extending claw-like arm at a height roughly at the top of a 2×4 plate and having a perpendicularly downwardly extending pointed end adapted to be struck into the plate member. The tool, after being driven into the plywood floor and with the claw-like arm driven into 2×4 plate member of a wall frame, is operated by the elongated handle to drag or pull the 2×4 plate member towards the pivot point where the tool is struck into the plywood floor a distance as desired to straighten the plate member. The tool is made of steel so that it can be struck by a hammer or other tool to drive the shaft into the plywood floor and likewise the laterally extending arm at a top surface where it can be struck by hammer to drive it into the plate member. The method of use of the wall puller tool is simply effected by driving the pointed ends into the floor and the plate member and as desired, either pulling the wall or pushing it to the desired alignment.

1 Claim, 5 Drawing Figures

WALL PULLER TOOL

SUMMARY OF THE INVENTION

In the building construction industry, wall frames are conventionally constructed of horizontal 2×4 or 2×6 plate members laid on a plywood floor and having studs and a top plate member in the construction of a wall frame. Such frames, conventionally are covered at one side with sheathing, drywall, insulation wall or the like so that one side of the frame is covered. In the alignment and straightening of such frames comprising the horizontally extending plate members laid on a plywood floor with the vertically extending studs, there has been a long standing problem in effecting the alignment to overcome warpage and deformation of one cause or another. Pulling of the wall where it is to be pulled away from the side that has the sheathing on it is quite difficult since the far side of the wall is not readily accessible.

By means of the instant invention, there has been devised a simplified and improved wall pulling tool and method of use for simply pulling the plate member into alignment with a straight line or chalk line conventionally a distance of one half inch, one inch or the like. The tool is comprised of a steel shaft or pin member having a pointed lower end and a top end which can be simply struck by a hammer to stick or drive the pin into a conventional plywood floor that is used in construction. A laterally extending claw-like arm is pivoted to the shaft at approximately the top of the 2×4 plate such as about one and one half inch from the pointed end. The laterally extending arm is of steel construction and extends two or three inches to a foot or so, laterally and has downwardly perpendicularly extending pointed member which is adapted to be struck at an impact surface at the top of the end of the arm into the plate member.

The wall pulling tool is easily used by simply striking or tapping the top end of the shaft into the floor positioning the pointed end of the pulling arm at the top of the plate member. The pointed end of the arm is then tapped into the plate member. The pulling operation is completed by grasping the top end of the shaft which serves as a handle and forcefully moving it away from the wall about the pivot point on the floor where the lower pointed end is stuck to pull the wall the desired distnce to alignment.

After the wall has been pulled to the selected position, a previously started nail in the plate member is driven into the plywood floor while holding the tool and the wall to the selected position. Due to the elongated feature of the handle, the mechanical advantage obtained by pivoting the laterally extending arm adjacent the lower end is such that a great deal of force can be manually applied to the handle to pull the wall in the desired position and the user can hold the tool to position with one hand while driving the nail with his free hand.

The wall pulling tool of this invention can be simply used by carpenters, laborers, and other workmen to obtain the desired wall pulling, or pushing as the case may be, to the desired position. The tool is very rugged in construction due to its steel fabrication and can be used by relatively unskilled workmen with a high degree of efficiency and simplification in the method of use.

The above features are objects of this invention and further objects will appear in the detailed description which follows and will be otherwise apparent to those skilled in the art.

For the purpose of illustration of this invention, there is shown in the accompanying drawings preferred embodiments thereof. It is to be understood that these drawings are for the purpose of illustration only and that the invention is not limited thereto.

IN THE DRAWINGS

DESCRIPTION OF THE INVENTION

Figure 2:
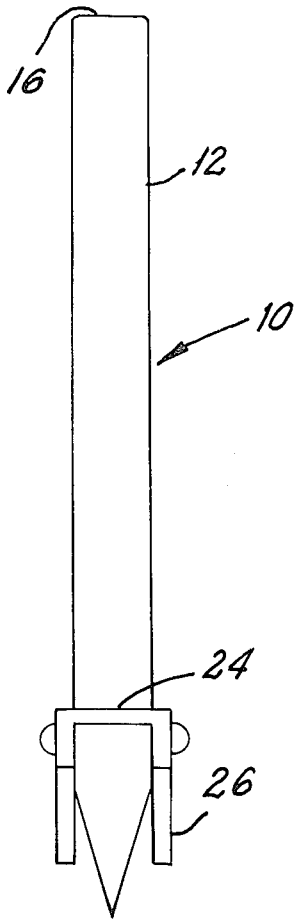
FIG. 2, is a view in front elevation of the tool.
Figure 1:
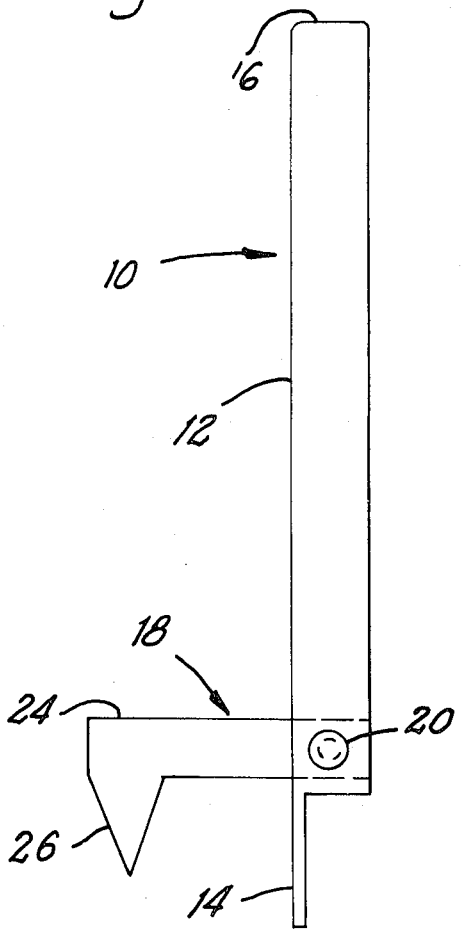
FIG. 1, is a view in side elevation of the wall pulling tool.
Figure 4:
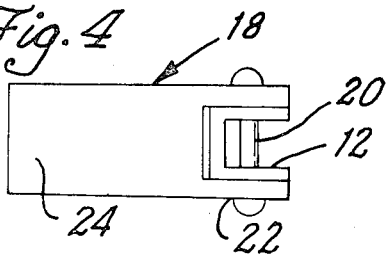
FIG. 4, is a top plan view of the tool.
Figure 3:
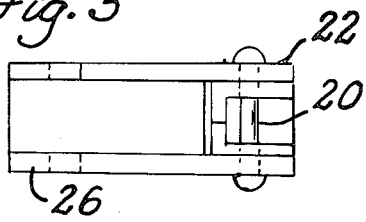
FIG. 3, is a bottom plan view of the tool.

The wall puller tool of this invention is generally indicated by the reference numeral 10 in FIGS. 1, 2 and 3. It is comprised of elongated steel shaft 12, having a channel or U-shaped cross-section. Shaft 12 has a lower end 14 which has a triangular point and a square top 16 which serves as an impact receiving surface to be struck by a hammer or the like.

A laterally extending claw-like arm 18 is pivoted by a pivot pin 20 passing through the lower end of the shaft 12. The arm 18 is bifurcated at the end through members 22 which receive the pivot pin. The arm extends laterally a selected distance such as two or three inches up to a foot or so in length. This arm is likewise made of a U-shaped steel channel member and has a top impact surface 24 at the free end. The sides of the channel shaped member extend downwardly and have triangular pointed ends 26 at both sides of the arm to provide a means for being stuck into a wooden plate member when the impact surface 24 is struck lightly by a hammer or the like or otherwise caused to be forced downwardly to stick the pointed ends 26 into the plate.

In order to provide a strong mechanical advantage and proper positioning of the pointed end of the laterally extending claw member or arm, the pivot pin 20 is positioned about one and one-half above the pointed bottom end 14 which positioning approximates the top of the 2×4 plate member when it is laid flat on its side on the floor. The shaft 12 extends roughly a foot to two feet in order that the top portion which serves as a handle can provide a great mechanical advantage and the user can apply a great amount of force in pulling the wall about the pivoted portion where the shaft is stuck into the plywood floor.

The laterally extending arm 38 is pivoted by pivot pin 50 passing through the steel rods 40 and 42 in the same fashion as the earlier described embodiment of tool 10. Thus, the distance of the pivot pin above the pointed end is also approximately one and one half to two inches to provide for proper positioning on the top of the plate member.

METHOD OF USE

The wall puller tools of both embodiments 10 and 30 are used in a like fashion. Where the wall is desired to be pulled, a slight distance such as an inch or two to a conventional straight line or chalk to correct any deformations caused by warping or the like, the tool is very simply adapted to be used to pull the wall along a plywood floor.

Figure 5:
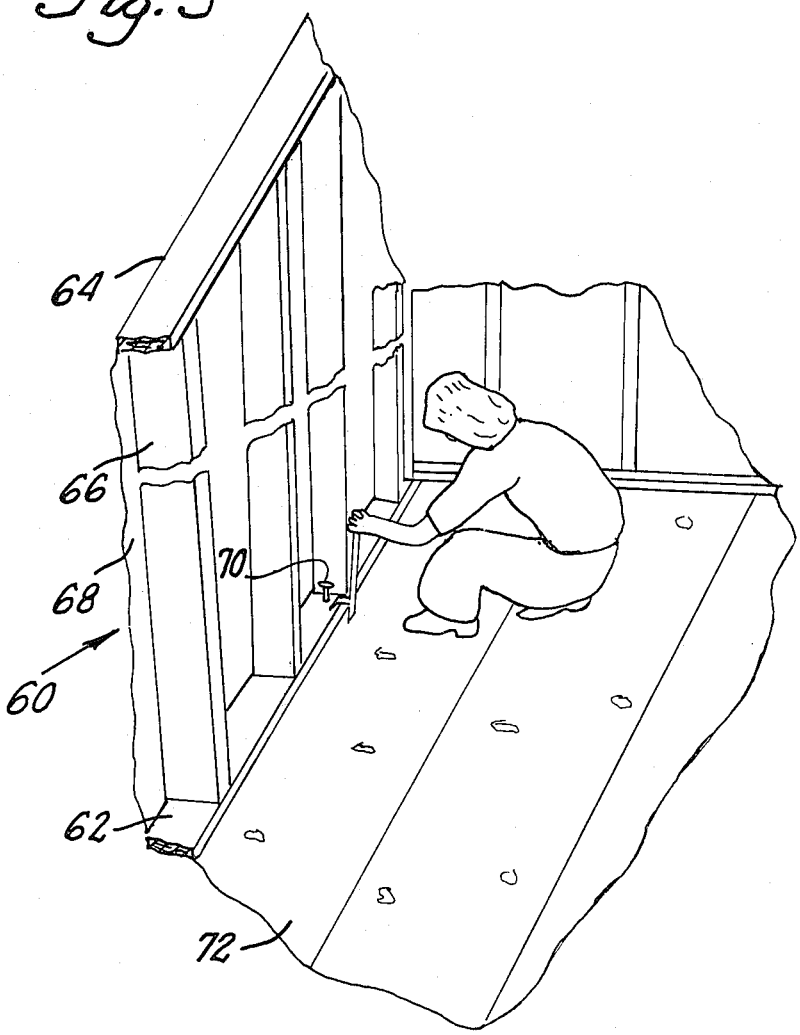
FIG. 5, is a pictorial view showing the use of the wall puller tool.

The use is well known in FIG. 5, on a conventional wall 60, comprised of a bottom plate member 62, a top plate member 64 and usual vertical studs 66. In such a wall where a sheath 68 has been connected to the far side of the wall, such as by nailing drywall, plywood sheathing, insulation boards or the like, the far side of the wall is inaccessible to a worker desiring to pull the wall in the direction opposite the far side connected wall member.

In the method of this invention, a starter nail such as a conventional 12 or 16 common nail 70 is first partially driven through the plate member 62 but is not yet driven so far as to pierce the underlying plywood floor 72. The wall puller tool is then positioned to a point where the lower pointed end of the steel shaft 12 is directly under the vertically aligned shaft while the downwardly depending pointed end 26 of the laterally extending claw-like arm 24 overlies the middle portion of the plate member. Then the impact surfaces at the top of the shaft, namely, impact surface 16 and the impact surface 24, of the arm, are struck or tapped with a hammer to stick the ends into the plywood floor and plate member.

After the pointed ends of the shaft and the laterally extending arm or claw member have been stuck into the plywood floor and the wooden 2×4 plate member, the handle is grasped at the top and simply pulled or pivoted about the pivot point away from the wall. This operation causes through the great mechanical advantage obtained by the location of the pivot point to pull the plate member to the desired position on the floor usually a half inch to one inch or so. This is accomplished by simply using one hand or two hands where required, but to hold the puller tool with the wall in the newly pulled position, only one hand is required. The free hand of the user is then used to hammer the starter nail 70 into the plywood floor to fix the wall in the desired position. The operation is thus completed for pulling the selected portion of the wall to the desired alignment.

Where another portion of the wall is desired to be pulled, the operation is simply repeated. It will be understood, in addition to pulling the wall, the tool may be used in the same fashion to push the wall by simply reversing the movement of the handle toward the wall to effect the pushing of the wall to the desired alignment.

Various changes and modifications may be made within this invention as will be readily apparent to those skilled in the art. Such changes and modifications are within the scope and teaching of this invention as defined by the claims appended hereto.

What is claimed is:

1. A wall puller tool for pulling a skeleton construction wall having a plate member an incremental distance along a floor comprising an elongated steel handle member having a pointed end adapted to be struck at the top end into said floor at a pivot point and a laterally extending claw member pivotably connected at a first end to a lower portion of said handle and having a second end provided with a downward perpendicularly extending pointed portion to be struck into said plate, said handle being forcefully moveable away from said plate about its pivoted end at the pivot point on the floor to cause said plate member to be pulled toward said pivot point, said claw member extending laterally from said pivotable connection about two to twelve inches and the top end of the handle member and the top of the second end of the claw member being provided with an impact surface adapted to be struck by a hammer, the shaft member and the claw member having a channel shaped cross-section to provide rigidity, said claw member cross-section including an integral member having opposed side walls and a top wall, said top wall providing an impact surface adapted to be struck by a hammer, and each of said side walls having a downwardly extending pointed portion at said second end and forming a bifurcated portion at said first end pivotably connected to said handle member.

* * * * *